United States Patent [19]

Eble et al.

[11] 4,432,469

[45] Feb. 21, 1984

[54] DEVICE FOR DISCHARGING A PLURAL-COMPONENT MATERIAL

[75] Inventors: Monika Eble; Gusztav Lang, both of Munich, Fed. Rep. of Germany

[73] Assignee: Hilti Aktiengesellschaft, Schaan, Liechtenstein

[21] Appl. No.: 213,180

[22] Filed: Dec. 4, 1980

[30] Foreign Application Priority Data

Dec. 7, 1979 [DE] Fed. Rep. of Germany ..... 2949369

[51] Int. Cl.[3] ..... B65D 83/00

[52] U.S. Cl. ..... 222/134; 222/87; 222/137; 222/390

[58] Field of Search ..... 222/137, 144.5, 145, 222/548, 142.9, 135, 555; 239/304

[56] References Cited

U.S. PATENT DOCUMENTS

| | | | |
|---|---|---|---|
| Re. 28,120 | 8/1974 | Plumer | 222/555 X |
| 960,650 | 6/1910 | Lind | 222/142.9 |
| 3,339,810 | 9/1967 | Block et al. | 222/548 X |
| 3,390,814 | 7/1968 | Creighton, Jr. et al. | 222/137 |
| 3,570,719 | 3/1971 | Schiff | 222/137 |
| 3,587,982 | 6/1971 | Campbell | 222/145 X |
| 3,746,216 | 7/1973 | Frederick | 222/137 |
| 3,774,816 | 11/1973 | Bratton | 222/145 X |

FOREIGN PATENT DOCUMENTS

| | | | |
|---|---|---|---|
| E 10913 | 9/1956 | Fed. Rep. of Germany | 222/137 |
| 1138690 | 1/1969 | United Kingdom | 222/144.5 |

*Primary Examiner*—Joseph J. Rolla
*Assistant Examiner*—Frederick R. Handren
*Attorney, Agent, or Firm*—Toren, McGeady and Stanger

[57] ABSTRACT

A device for discharging measured amounts of a plural-component material, such as an adhesive, filling, sealing or putty-like substance includes an axially extending casing having a first end. The interior of the casing is divided into separate compartments each having a discharge opening at the first end. A mixing chamber is positioned at the first end of the casing for receiving the components discharged from the compartments. A slide plate is positioned between the first end of the casing and the mixing chamber and is rotatable about the axis of the casing. The slide plate has openings for passageways alignable with the discharge openings for admitting selective amounts of the components into the mixing chamber.

12 Claims. 6 Drawing Figures

Fig. 1
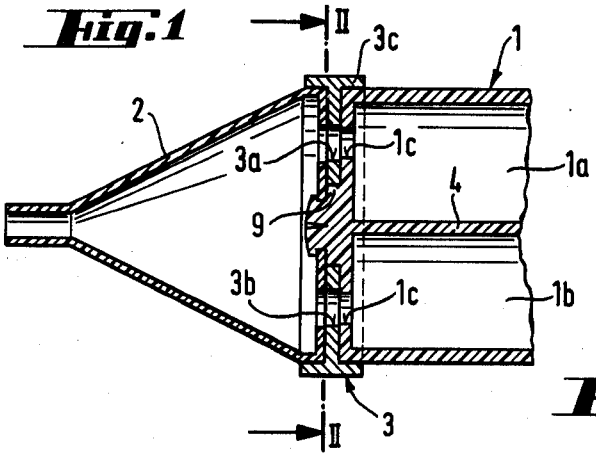
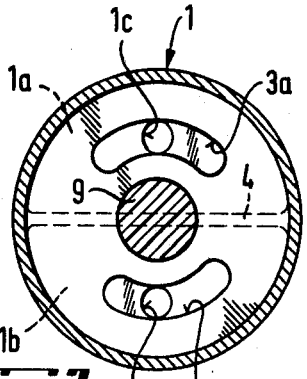
Fig. 2
Fig. 3
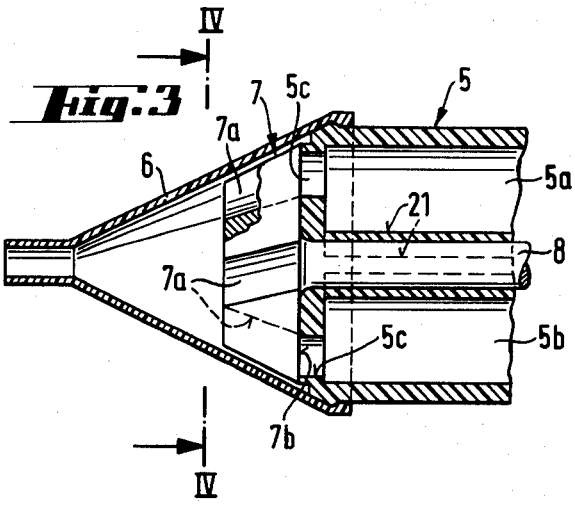
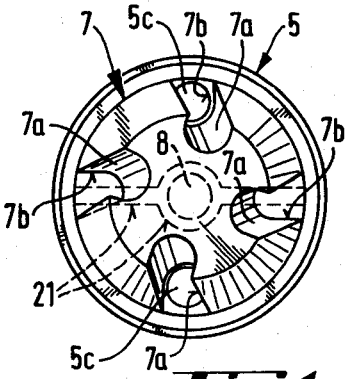
Fig. 4
Fig. 5
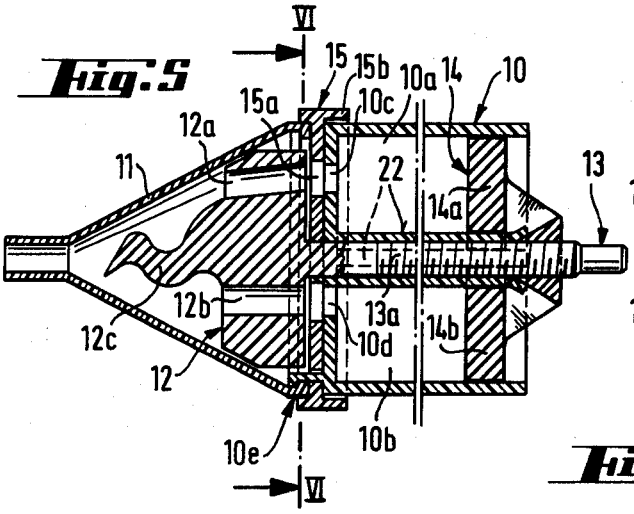
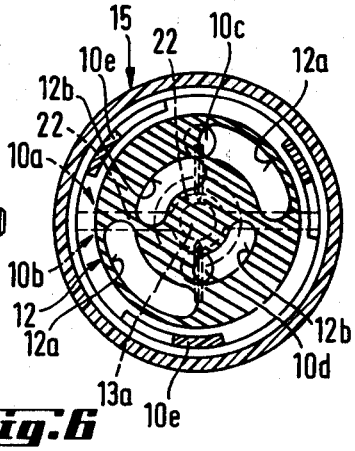
Fig. 6

DEVICE FOR DISCHARGING A PLURAL-COMPONENT MATERIAL

SUMMARY OF THE INVENTION

The present invention is directed to a device for the measured discharge of a two-component or multi-component adhesive, sealing, filling or putty substance with discharge openings in the compartments holding the components.

Recently plural-component systems have been used increasingly because of their properties, such as a short hardening period, high elasticity and strength as well as good chemical resistance. During processing, however, there is the problem of limited pot time, that is, the mixed components must be used within a short period of time. As a result, to-date the components have been packed separately in small amounts. Such packaging results in considerable work in using the components and is especially disadvantageous if different amounts of the components are required. It has been known to mix a large amount of the components and to process them by means of a device. In such an arrangement, because of the required amounts and the quantities usually left over, the loss in no longer useful material is relatively high. When there are long interruptions in the use of the device, it must be emptied and cleaned during each down period and this results in a considerable expenditure of time.

Therefore, it is the primary object of the present invention to provide a simple device for the measured discharge of two-component or multi-component systems where the device can be utilized even where long interruptions occur between periods of use without any significant losses occurring in time or material.

In accordance with the present invention, the device includes a rotary shield connected between the discharge openings for the components and a mixing chamber. The rotary shield or plate has passageways which can be aligned with the discharge openings for passing the components from the openings into the mixing chamber. The components are stored within separate compartments in the device and are mixed only shortly before use. In accordance with the present invention, the rotary plate is simple to produce and makes it possible to close the discharge openings with little applied force even when using very viscous components. During long interruptions in operation, only the completely or partially mixed components which have exited from the discharge openings into the rotary shield need to be removed from the device. As a result, there is a considerable decrease in the amount of waste material.

If no special stop elements are provided, it is difficult to secure the rotary shield in the exact open position during operation. To obtain a sufficiently large flow cross-section even during scattering which results during operation, it is practical if the passageways through the shield or plate have larger cross-sectional areas than the discharge openings from the compartments.

For certain applications, a longer or shorter hardening period may be required. This problem can be met by using different mixing ratios. To provide this variable mixing effect the passageways through the rotary shield or plate can be angularly offset relative to the discharge openings from the compartments. With such an arrangement the mixing ratio can be varied by selective positioning of the rotary shield. The different positions of the rotary shield can be labeled with the corresponding pot time.

Plural component systems are very often processed by auxiliary personnel. To avoid any problems, the discharge openings for the different components and the corresponding passageways in the rotary shield can be arranged at different radii relative to the axis of rotation of the shield. With this arrangement it is possible to prevent any contact of the components before they are to be mixed and, therefore, to avoid any premature hardening of the final product.

The components may be very viscous depending on their composition and the processing temperature. To achieve a clean separation of the outflowing strands of the components, advantageously the trailing edges of the passageways in the rotary shield are provided with knife-edges. Accordingly, the material discharged is cleanly cut off by the rotary shield at the discharge openings. In this way it is also possible to prevent the rotary shield from being blocked by the material being discharged.

After the components are combined, they must be mixed with one another to achieve the final hardening effect. Therefore, it is advantageous if the rotary shield is constructed as a rotational slide. By continuously rotating the shield or slide, the components are mixed in the passageways extending through the shield from the discharge openings into the mixing chamber. Pulse-like partial strands result instead of continuous strands due to the opening and closing of the discharge openings. This arrangement improves the mixing of the components.

The rotational slide can be driven manually or by a friction drive. In an advantageous embodiment, the rotational slide is connected to a central drive shaft. The drive shaft can be driven by clamping the shaft into the collet of a hand-held drill. Further, a separate, mountable rotary drive can be used.

In operation, the material components can be pressed out of their compartments by an axially movable plunger. This plunger can be moved manually or by a drive mechanism. If a central drive shaft is used, the shaft can be in the form of a feed screw for the plunger. When the drive shaft is rotated, the plunger presses the components out of their compartments.

If the components are especially viscous, pulse-like discharging as well as mixing by means of the rotational slide is not sufficient. In such instances it is advantageous to provide the rotational slide with a mixing attachment. The mixing attachment may be in the form of a wing or a helix. A helix also provides the movement of the mixture within the mixing chamber.

In a driven rotational slide it is not always possible to secure the slide in position for closing the discharge openings. Therefore, it is advantageous to position a shut-off slide between the discharge openings and the rotational slide.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing

FIG. 1 is an axially extending sectional view of a part of a device embodying the present invention and incorporating a simple rotary shield;

FIG. 2 is a sectional view through the device in FIG. 1 taken along the line II—II;

FIG. 3 is a view, mainly in section, similar to the view taken in FIG. 1, illustrating another embodiment of the invention incorporating a rotational slide;

FIG. 4 is a sectional view of the device displayed in FIG. 3, taken along the line IV—IV;

FIG. 5 is an axially extending sectional view of a device embodying the present invention and including a rotational slide and a shut-off slide; and FIG. 6 is a sectional view of the device shown in FIG. 5 and taken along the line VI—VI.

DETAILED DESCRIPTION OF THE INVENTION

In FIG. 1 a device is shown for the measured discharge of plural-component substances, such as adhesive, sealing, filling or putty substances. Only the front or discharge end of the device is illustrated in FIG. 1 including a casing 1 with a mixing chamber 2 connected to the discharge end of the casing by a stop lock or catch, not shown. As can be seen from FIGS. 1 and 2, the casing 1 is divided into two compartments 1*a*, 1*b* separated from one another by a dividing wall 4. In the discharge end of the casing, that is, the end adjoining the mixing chamber, each compartment has a circular discharge opening 1*c*. A rotary shield or plate 3 is positioned between the discharge end of the casing 1 and the mixing chamber 2. A shaft stub 9 is centered at the discharge end of the casing 1 and projects into the mixing chamber 2. The rotary shield 3 is rotatable about the shaft stub 9. Rotary shield 3 has passageways 3*a*, 3*b* which can be positioned in line with the outlet openings 1*c* for discharging the components from the compartments 1*a*, 1*b* through the discharge openings 1*c*, and the passageways 3*a*, 3*b* into the mixing chamber. An annular rim 3*c* is formed about the circumferential periphery of the rotary shield 3 and fits against the casing 1 and the mixing chamber 2 so that the rotary shield can be turned into an open or closed position.

In the sectional view through the device illustrated in FIG. 1, and shown in FIG. 2, the discharge openings 1*c* of the casing 1 are positioned diametrically opposite one another across the axis through the shaft stub 9. The passageways 3*a*, 3*b* through the rotary shield 3 are arranged at the same radial dimension from the center of the shaft stub 9 as the discharge openings 1*c*. While the discharge openings 1*c* are circular, in transverse section, the passageways 3*a*, 3*b* have an elongated kidney shape affording a much larger cross-sectional area than the discharge openings 1*c*. While the radial dimension of the passageways 3*a*, 3*b* is approximately the same as that of the discharge openings 1*c*, the angular dimension of the passageways relative to the center of the casing is much greater. Due to this construction, it is possible to keep the discharge openings 1*c* open over a relatively large angular range of movement of the rotary shield or plate 3. While the passageways 3*a*, 3*b* are approximately opposite one another, they are not exactly symmetrically opposite. Due to this arrangement, the mixing ratio of the two components, contained in the compartments 1*a*, 1*b* can be changed in the adjustment position bordering the locking position. The mixing ratio of the components also influences the hardening time of the resulting mixed substance.

In FIGS. 3 and 4 another embodiment of the device of the present invention is displayed and includes a casing 5 and a mixing chamber 6 secured to the front or discharge end of the mixing chamber by an interfitting locking arrangement. A rotational slide 7 is located within the mixing chamber 6 immediately in front of the discharge end of the casing 5. Rotational slide 7 has axially elongated passageways 7*a* located in and extending inwardly from the periphery of the slide. The entrance ends of the passageways 7*a*, which initially receive the components from the mixing chamber, are provided with knife-like edges 7*b*. A drive shaft 8 is centered within the casing and the rotational slide is connected to the drive shaft so that it can be rotated by the shaft. The interior of the casing 5 is divided into compartments 5*a*, 5*b* by a dividing wall 21, note the dashed line showing in FIG. 4. The components within each of the compartments 5*a*, 5*b* are pressed out through the discharge openings 5*c* by means of a pressing device, not shown. Strands of the individual components pressed out of the compartments 5*a*, 5*b* pass into the passageways 7*a* and are cut off by the edges 7*b*. As a consequence, the component strands reach the mixing chamber in pulses. With the rotational slide 7 closing the discharge openings 5*c* through the end of the casing, to clean the device, it is only necessary to remove the mixing chamber 6 from the casing 5 and, if necessary, a new mixing chamber can be placed on the casing.

FIG. 4 is a front end view of the rotational slide 7 and the casing 5. For sake of clarity, the mixing chamber 6 has been omitted. Accordingly, the overall configuration of the rotational slide 7 with its passageways 7*a*, distributed around its periphery, can be clearly seen. As viewed in FIG. 4, two diametrically opposed passageways 7*a* are located in alignment with the discharge openings 5*c* from the end of the casing 5. As the rotational slide is rotated, the discharge openings 5*c* are closed. After rotation through an angle of approximately 180°, the same passageways 7*a* are located in front of the other openings 5*c*. With a 90° rotation the other pair of passageways 7*a* would be aligned with the discharge openings 5*c*. In this manner, as the rotational slide is rotated, first one of the components enters the passageways 7*a* and then the other component enters. Due to the friction generated on the inside wall of the mixing chamber 6 with the components within the passageways 7*a*, a mixing action is effected as the components flow through the passageways. The mixing process is continued in the mixing chamber 6 until the mixture finally exits through the outlet nozzle from the mixing chamber.

In FIGS. 5 and 6 another embodiment of the invention is exhibited which includes a casing 10 with a mixing chamber 11 mounted on its discharge end with the chamber connected to the casing by locking means. A rotational slide 12 is located in the mixing chamber adjacent the discharge end of the casing. The interior of the casing is divided into compartments 10*a*, 10*b* by a dividing wall 22 with each of the compartments holding a separate component. Each compartment 10*a*, 10*b* has an outlet opening 10*c*, 10*d*, respectively. As can be seen in FIGS. 5 and 6, the discharge openings 10*c*, 10*d* are located diametrically opposite one another relative to the central axis of the casing and the radial distance of each discharge opening from the central axis is different. Similarly, rotational slide 12 is provided with passageways 12*a*, 12*b* similar in shape to those shown in FIG. 2. The passageways 12*a* are arranged to align with the discharge opening 10*c* while the passageways 12*b* align with the discharge opening 10*d*, in other words, the passageways are spaced radially outwardly from the central axis of the casing by a dimension corresponding to the dimension of the discharge opening with which they cooperate. The rotational slide 12 is connected to a central drive shaft 13 coaxial with the central axis of the casing 10. A portion of the drive shaft 13 is formed as a feed screw 13*a*. Feed screw 13*a* serves to displace a twin plunger 14 having heads 14*a* within the compartment 10*a* and head 14*b* within the compartment 10*b*. As the heads are displaced through the compartments by the feed screw 13*a* the components within the compartments are pressed out of the discharge openings 10*c*, 10*d*. Plunger heads 14*a*, 14*b* are connected together by knife-like connecting bars, not shown, which make it possible during advancement to cut through a dividing wall 22 enclosing the drive spindle so that the plunger can be displaced axially along the feed screw 13*a* of the drive shaft 13. A shut-off slide 15 extends transversely of the axis 13 of the drive shaft and is positioned between the discharge end of the casing 10 and the rotational slide 12. Shut-off slide 15 has bores 15*a* therethrough as well as an outside rim 15*b* which permits the shut-off slide to be rotated about the drive shaft or spindle 13. The discharge openings 10*c*, 10*d* from the casing 10 can be closed by the shut-off slide 15. In the closed position, the shut-off slide 15 prevents any further flow of the components from the compartments 10*a*, 10*b*. With the shut-off slide 15 in the closed position, mixing chamber 11 and the rotational slide 12 can be removed for cleaning purposes.

The sectional view of FIG. 5, shown in FIG. 6, shows the discharge openings 10*c*, 10*d* spaced at different radial dimensions outwardly from the central axis of the casing. The passageways 12*a*, 12*b* through the rotational slide 12 are similarly offset from the axis of the casing. Discharge openings 10*c*, 10*d* are alternately opened and closed as the rotational slide 12 is rotated. The shut-off slide 15 is rotatable to a limited extent by means of stops 10*e* attached to the casing 10 which form a part of the locking arrangement of the device. During operation, shut-off slide 15 remains open. A mixing attachment 12*c* forms a part of the rotational slide 12 and extends outwardly from the slide toward the nozzle outlet from the mixing chamber 11. The mixing attachment is shaped to facilitate mixing of the components exiting from the passageways 12*a*, 12*b* into the portion of the mixing chamber forward of the passageways.

While specific embodiments of the invention have been shown and described in detail to illustrate the application of the inventive principles, it will be understood that the invention may be embodied otherwise without departing from such principles.

What is claimed is:

1. Device for the measured discharge of a plural-component material such as an adhesive, sealing, filling or putty-like substance comprising a casing having a first end, said casing divided into separate compartments each extending from said first end, each said compartment arranged to hold a component of the plural-component material so that the components are maintained separate until ready to be mixed, each of said compartments having a discharge opening at said first end of said casing, a mixing chamber mounted on said first end of said casing for receiving the components from said compartments, a member interposed between said first end of said casing and said mixing chamber, said member being rotatable about an axis extending transversely of said first end, said member having passageways extending therethrough alignable with said discharge openings from said first end of said casing for conveying the components of the plural-component material from said compartments into said mixing chamber, said rotatable member is a rotational slide, a shut-off slide rotatable about the same axis as said rotational slide and located between said first end of said casing and said rotational slide, said shut off slide having bores therethrough for permitting flow between said discharge openings from said compartments into said passageways through said rotational slide so that by selectively rotating said shut-off slide flow from said compartments can be blocked.

2. Device, as set forth in claim 1, wherein said passageways in said rotatable member having a larger cross-sectional area than said discharge openings.

3. Device, as set forth in claim 1, wherein said passageways are angularly offset relative to said discharge openings when said passageways and discharge openings are in alignment.

4. Device, as set forth in claim 1, wherein said casing having a central axis, said discharge openings being spaced at different radial dimensions from the central axis and each said discharge opening having a corresponding said passageway spaced at the same radial dimension from the central axis.

5. Device, as set forth in claim 1, wherein a central drive shaft centered within and extending through the first end of said casing into said mixing chamber, said rotational slide being connected to said drive shaft.

6. Device, as set forth in claim 5, wherein said drive shaft being formed at least in part as a feed screw, and a plunger secured to said feed screw and being axially displaceable thereon within each of said compartments for displacing the components within said compartments out of the discharge openings in the first end of said casing.

7. Device, as set forth in claim 1, wherein a mixing attachment is secured to said rotational slide and extends outwardly from said rotational slide in the direction away from said first end of said casing.

8. Device, as set forth in claim 1, wherein said discharge openings from said compartments in said casing being circular and said passageways in said rotatable member having an elongated kidney-like configuration with said passageways being alignable with said discharge openings as said member is rotated.

9. Device for the measured discharge of a plural-component material such as an adhesive, sealing, filling or putty-like substance comprising a casing having a first end, said casing divided into separate compartments each extending from said first end, each said compartment arranged to hold a component of the plural-component material so that the components are maintained separate until ready to be mixed, means within the casing for urging the material in each compartment toward said first end in any orientation of said casing, each of said compartments having a discharge opening at said first end of said casing, a mixing chamber mounted on said first end of said casing for receiving the components from said compartments, a member interposed between said first end of said casing and said mixing chamber, said member being rotatable about an axis extending transversely of said first end, said member having passageways extending therethrough alignable with said discharge openings from said first end of said casing for conveying the components of the plural-component material from said compartments into said mixing chamber, said rotatable member is a rotational slide, and a central drive shaft centered within and extending through the first end of said casing into said mixing chamber, said rotational slide being connected to said drive shaft.

10. Device, as set forth in claim 9, wherein said drive shaft being formed at least in part as a feed screw, and wherein the means within the casing includes a plunger secured to said feed screw and being axially displaceable thereon within each of said compartments for displacing the components within said compartments out of the discharge openings in the first end of said casing.

11. Device, as set forth in claim 9, wherein said central drive shaft having a central axis extending transversely of said first end of said casing, said rotatable member being rotatable by said drive shaft about the central axis thereof and said rotatable member extending in the axial direction of the central axis, each of said passageways through said rotatable member having a first end adjoining the first end of said casing and the first ends of said passageways having knife-like edges for cutting off the component strands passing from said discharge openings into said passageways as said rotatable member is rotated past said discharge openings.

12. Device, as set forth in claim 11, wherein said passageways through said rotatable member being open on the circumferential periphery of said rotatable member so that the components being passed therethrough can be mixed by the frictional engagement with the inner surfaces of said mixing chamber.

* * * * *